US007396293B2

(12) United States Patent
Soracco

(10) Patent No.: US 7,396,293 B2
(45) Date of Patent: Jul. 8, 2008

(54) HOLLOW GOLF CLUB

(75) Inventor: Peter L. Soracco, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 219 days.

(21) Appl. No.: 11/063,887

(22) Filed: Feb. 24, 2005

(65) Prior Publication Data

US 2006/0189407 A1 Aug. 24, 2006

(51) Int. Cl.
*A63B 53/04* (2006.01)

(52) U.S. Cl. ..... 473/329; 473/332; 473/334; 473/345

(58) Field of Classification Search ..... 473/324, 473/350

See application file for complete search history.

(56) References Cited

U.S. PATENT DOCUMENTS 5,492,327 A * 2/1996 Biafore, Jr. ..... 473/332
6,428,426 B1 * 8/2002 Helmstetter et al. ..... 473/330
6,743,118 B1 6/2004 Soracco ..... 473/342
7,147,572 B2 * 12/2006 Kohno ..... 473/314

FOREIGN PATENT DOCUMENTS

JP 2004174224 A * 6/2004
JP 2004351054 A * 12/2004

* cited by examiner

*Primary Examiner*—Alvin A. Hunter, Jr.
(74) *Attorney, Agent, or Firm*—Bingham McCutchen LLP

(57) ABSTRACT

A golf club with improved performance over a larger percentage of the strike face, including the lower extremities of the face, is disclosed and claimed. The club head has a coefficient of restitution that approaches substantial uniformity across the face. The golf club head includes a body having a face, a sole, a transition zone between the face and the sole. The transition zone has an internal surface and an external surface. Both the internal and external surfaces have radii of curvature greater than 0.2 inch. The transition zone transitions smoothly from the face, through the transition zone, to the sole. An extension may be provided adjacent the transition zone, cooperating with the transition zone to form a chamber. Dampening and/or weight inserts may be positioned within the chamber.

9 Claims, 3 Drawing Sheets

HOLLOW GOLF CLUB

BACKGROUND OF THE INVENTION

1. Field of the Invention

The present invention relates to a golf club, and, more particularly, the present invention relates to a golf club with improved performance over a larger percentage of the strike face.

2. Description of the Related Art

It is known to make wood-type golf clubs out of metallic materials. These clubs were originally manufactured primarily by casting durable metals such as stainless steel, aluminum, beryllium copper, etc. into a unitary structure comprising a metal body, face, and hosel. As technology progressed, it became more desirable to increase the performance of the face of the club, usually by using a titanium material.

With a high percentage of amateur golfers constantly searching for more distance on their drives, the golf industry has responded by providing golf clubs specifically designed with distance in mind. The head sizes of wood-type golf clubs have increased, allowing the club to possess a higher moment of inertia, which translates to a greater ability to resist twisting on off-center hits. However, known golf club heads tend to be "hotter" toward the top of the strike face. That is, the upper portion of the club face tends to result in longer and more desirable shots than the lower section of the face. This is because known clubs tend to have an acute angle between the face and sole surfaces. The radius for a typical leading edge is in the range from 0.100 inch to 0.150 inch, while the matching core radius (that is, the radius of the interior surface of the leading edge) is from 0.100 inch to 0.125 inch. This disparity effectively thickens this region with respect to the face (>0.085 inch) and the sole (>0.060 inch). This increased wall thickness along with the acute face-sole angle increases the structural rigidity of the bottom portion of the face, which in turn reduces the flexibility and lowers the coefficient of restitution (COR) of this area.

Thus, what is needed is a club head with improved performance over a larger percentage of the strike face, especially the lower portion of the face.

SUMMARY OF THE INVENTION

The present invention is directed to a golf club with improved performance over a larger percentage of the strike face, including the lower extremities of the face. The golf club head includes a body having a face, a sole, a transition zone between the face and the sole. The transition zone is more flexible than in previously available club heads, stretching the "hot zone" downward toward the leading edge of the club head. Thus, desirable golf shots are obtained from a larger area of strike locations of the face, making the club more playable.

The transition zone has an internal surface and an external surface. Both the internal and external surfaces have radii of curvature greater than 0.2 inch. The club face adjacent the transition zone has a first thickness, and the sole adjacent the transition zone has a second thickness less than or equal to the first thickness. The transition zone transitions smoothly between the first and second thicknesses. Optionally, the transition zone has a thickness between the first and second thicknesses. The first thickness may be from 0.8 inch to 0.1 inch and the second thickness is from 0.06 inch to 0.1 inch. The radii of curvature may be between 0.2 inch and 0.4 inch. The club head design disclosed herein beneficially provides a coefficient of restitution that approaches substantial uniformity across the face.

To preserve the classic look of metals/woods and to maintain a traditional profile, an extension may be provided adjacent the transition zone. The extension defines the leading edge of the club head, and is dimensioned similarly to leading edges of known golf clubs. The extension and the transition zone define a chamber therebetween. A resilient insert may be provided within the chamber to maintain structural integrity and to dampen vibration. Weight members may be used instead of or in conjunction with the resilient insert.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
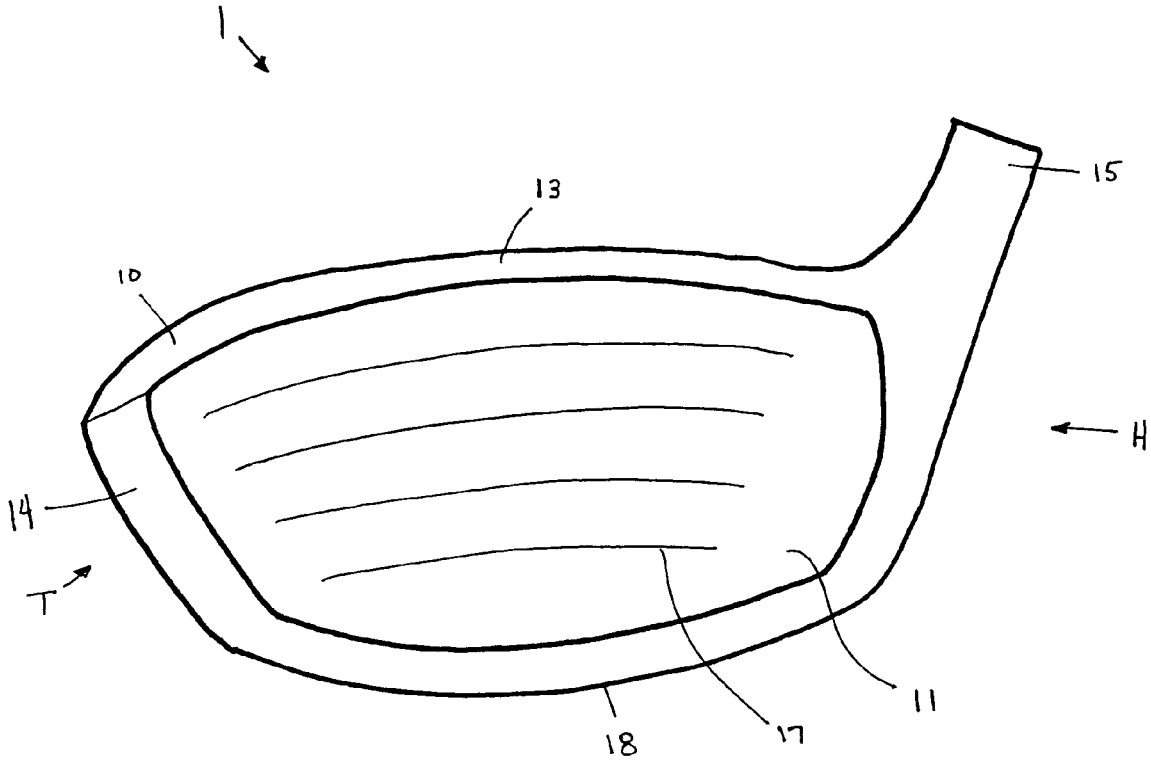
FIG. 1 shows a golf club head of the present invention.

The present invention relates to a golf club with improved performance over a larger percentage of the strike face, including the lower portion of the strike face. FIG. 1 shows a golf club head 1 of the present invention. The club head 1 includes a body 10 having a strike face 11, a sole 12, a crown 13, a skirt 14, and a hosel 15. The body 10 defines a hollow, interior volume 16. Foam or other material may partially or completely fill the interior volume 16. Weights may optionally be included within the interior volume 16. The face 11 may be provided with grooves or score lines 17 therein of varying design. The forward-most portion of the club, known as the leading edge, is illustrate by reference 18. The club head 1 has a toe T and a heel H.

COR is an important characteristic of golf clubs, especially wood-type golf clubs such as club head 1. COR is a measure of the efficiency of the transfer of energy between two colliding bodies, in this case the golf club and the golf ball. As the efficiency of the energy transfer increases, the COR, the initial ball velocity, and the ball travel distance increase. During a golf shot, the club face and the golf ball deform upon impact. The club face can deform and then recover more than the ball can. The ultimate aim of the dynamics or physics of the collision is to limit the amount of deformation the ball sustains because more energy is lost from a perfect collision due to heat, etc. in the ball. By allowing the strike face 11 to deform or deflect as much as possible over a greater percentage of the face 11, a higher performance strike face 11 can be constructed. As the amount of club face deformation increases, so do the club head COR and the forces applied to the ball.

As described above, typical hollow golf clubs have an acute angle between the face and sole surfaces and a small radius of curvature for the leading edge. This translates to a thickened and stiff face-to-sole transition, which decreases the face flexibility in the surrounding area. Thus, the "hot spot" of these known clubs tends to be located toward the top of the strike face, and the lower part of the face tends to be less effective. In current testing of the COR values over the face of known club heads, points toward the lower side of the face have the greatest percentage loss with respect to the maximum COR measured. The golf club 1 of the present invention stretches the hot zone downward toward the leading edge by providing a face-to-sole transition that is more flexible than in previously available club heads.

Figure 2:
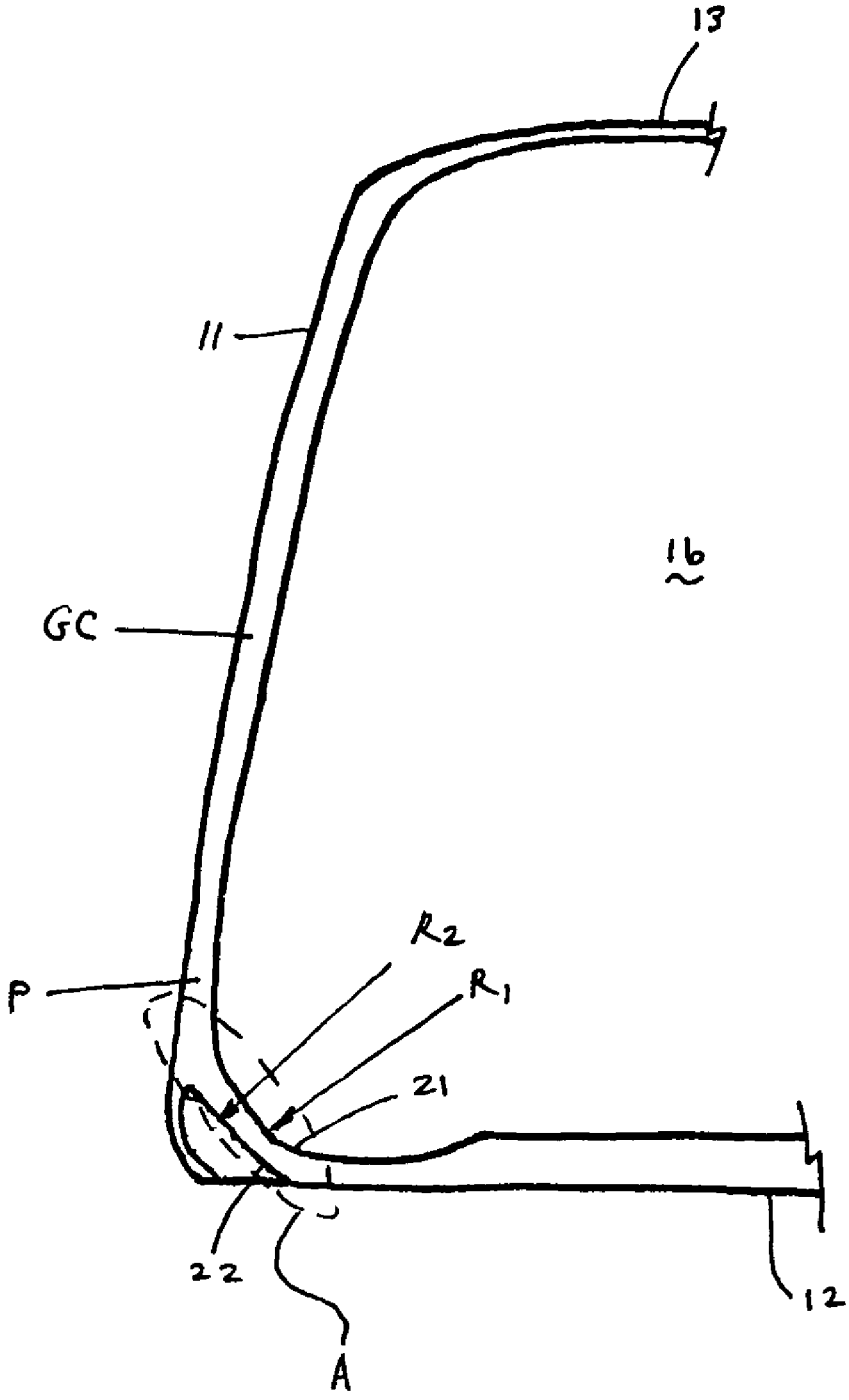
FIG. 2 shows a partial cross-sectional view of the golf club head of FIG. 1.

FIG. 2 shows a partial cross-sectional view of the golf club head 1, illustrating the face-to-sole transition zone A. In the embodiment illustrated in FIG. 2, the blend radius between the face 11 and the sole 12 is increased. This increased blend radius relieves the rigidity, increasing the flexibility of the transition zone A and increasing the COR of the lower face 11. The transition zone A includes an internal surface 21 having a first radius of curvature $R_1$ and an external surface 22 having a second radius of curvature $R_2$. Both the first and second radii $R_1$, $R_2$ are greater than 0.2 inch. Preferably, the first and second radii $R_1$, $R_2$ are between 0.2 inch and 1 inch. More preferably, the first and second radii $R_1$, $R_2$ are between 0.2 inch and 0.75 inch.

The transition zone A allows the thickness of the face 11 to be maintained, or even reduced, as it smoothly transitions to the sole 12. This enhances the COR of the face 11, especially toward the lower region thereof. The face 11 adjacent the transition zone A has a first thickness $t_1$, the sole 12 adjacent the transition zone A has a second thickness $t_2$, and the transition zone A has a third thickness $t_3$. The second thickness $t_2$ preferably is less than or equal to the first thickness $t_1$. The transition zone A preferably transitions smoothly between the first and second thicknesses $t_1$, $t_2$. In one preferred embodiment, the third thickness $t_3$ is intermediate the first thickness $t_1$, and the second thickness $t_2$. Preferably, the first thickness $t_1$ is from 0.04 inch to 0.15 inch and the second thickness $t_2$ is from 0.02 inch to 0.15 inch. More preferably, the first thickness $t_1$ is from 0.06 inch to 0.1 inch and the second thickness $t_2$ is from 0.04 inch to 0.08 inch.

Removing material from the transition zone A (as compared to known club heads) increases the flexibility of the face 11 adjacent the transition zone A and provides the club head 1 with a COR that is substantially higher on the lower half of the face 11. Preferably, the COR approaches substantial uniformity across the face 11. The face 11 has a geometric center GC with a first COR and a point P located a distance of 0.25 inch from the leading edge 18 with a second COR that is fractionally less than the first COR. That is, the face COR is approaches uniformity across the face 11 with only marginal decreases towards the face edges. Preferably, the face COR reduces proportionately in a concentric manner away from the geometric center GC. That is, the face has a first, substantially uniform COR in a first substantially circular region about the geometric center GC. The COR in a second substantially circular region about the first substantially circular region is, for example, approximately 98% of the first COR. The COR in a third substantially circular region about the second substantially circular region is, for example, approximately 95% of the first COR.

Figure 3:
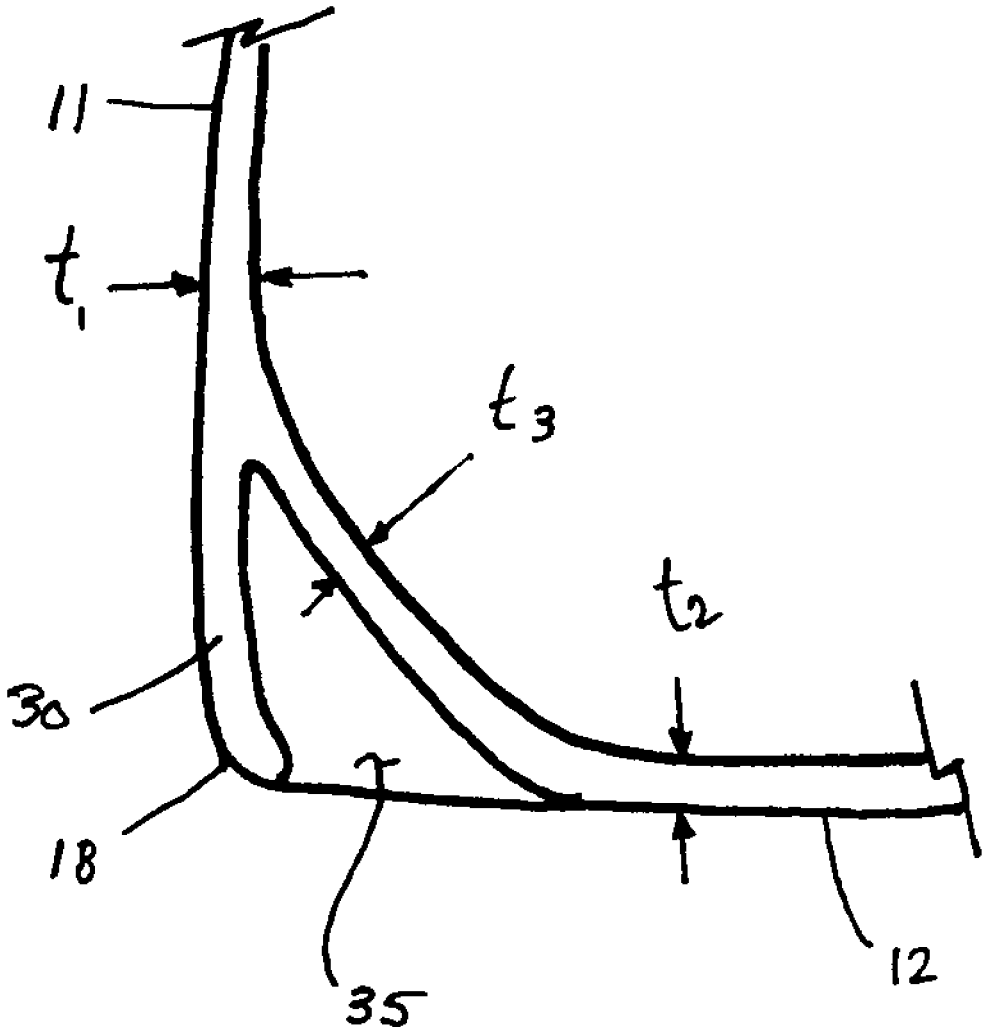
FIG. 3 shows a close up view of an extension and chamber of the golf club head of FIG. 1.

In order to keep the classic look of metals/woods with a traditional profile, a non-structural cantilever extension 30 extends beyond the transition radius, forming a chamber 35 adjacent the transition zone A. The extension 30 defines the leading edge 18 of the club head 1. FIG. 3 shows a close up view of the extension 30 and the chamber 35. In order to keep the extension 30 from bending or otherwise deforming during normal use, the chamber 35 preferably is filled with a resilient material that provides compressive resistance to the extension 30. The resilient material has strength properties that are much lower than the corresponding metal of the club body 10. Thus, the resilient material provides no structural enhancement, but may advantageously act as a damper to alleviate unwanted vibrations generated during normal use of the golf club. The resilient material may be retained within the chamber 35 by any suitable means, including through the use of an adhesive. A preferred material for use in chamber 35 is a polyurethane elastomer.

Alternatively, the chamber 35 can be filled, in part or in full, with a material having a density greater than the density of the face 11 material. Positioning dense materials within the chamber 35, which runs along the length of the leading edge 18, advantageously allows the club designer to shift the club head center of gravity and optimize the club head moment of inertia. In a preferred embodiment, chamber 35 is filled with a low-density resilient material into which localized concentrations of high-density material are inserted. For example, most of the chamber 35 may be filled with a low-density resilient material and high-density weight inserts may be positioned in toe and/or heel portions of the chamber 35.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A golf club head, comprising:

a body having a face, a sole, a toe, a heel, and a transition zone between said face and said sole, said transition zone extending from said toe to said heel;

wherein said face includes an extension adjacent said transition zone; and wherein said transition zone is curved and has a radius of curvature greater than 0.2 inch.

2. The golf club head of claim 1, wherein said extension defines a leading edge of the club head.

3. The golf club head of claim 1, wherein said extension and said transition zone define a chamber therebetween.

4. The golf club head of claim 3, further comprising an insert positioned within said chamber.

5. The golf club head of claim 4, wherein said insert includes a resilient material.

6. The golf club head of claim 4, wherein said insert includes a damper.

7. The golf club head of claim 4, wherein said insert includes a weight member.

8. The golf club head of claim 4, wherein said insert includes:

a first weight member in a toe portion thereof;

a second weight member in a heel portion thereof; and a resilient material intermediate said weight members.

9. The golf club head of claim 1, wherein the golf club head is a wood-type golf club head.

* * * * *